United States Patent [19]

Etheridge

[11] Patent Number: 4,804,148

[45] Date of Patent: Feb. 14, 1989

[54] CRUSHER CONTROL SYSTEM

[76] Inventor: Johnny E. Etheridge, 1744 Old Powhatan Estates Dr., Powhatan, Va. 23139

[21] Appl. No.: 157,982

[22] Filed: Feb. 19, 1988

[51] Int. Cl.[4] ..... B02C 25/00

[52] U.S. Cl. ..... 241/35; 241/207

[58] Field of Search ..... 241/207-216, 241/34, 35

[56] References Cited

U.S. PATENT DOCUMENTS 3,459,378 8/1969 Hill ..... 241/35

4,478,372 10/1984 Paterson et al. ..... 241/35

*Primary Examiner*—Mark Rosenbaum

*Attorney, Agent, or Firm*—Fay, Sharpe, Beall, Fagan, Minnich & McKee

[57] ABSTRACT

A control system for a rock crusher in a rock crushing plant operates the crusher at optimum efficiency for increasing the throughput of the crusher. The horsepower of the motor that drives the crusher is sensed, and the level of rock within the crusher bowl is sensed, and these sensed conditions are inputted into a programmable logic controller. The programmable logic controller correspondingly adjusts the feed rate of a feeder that supplies rock to the crusher. The controller also commands a bypass component positioned between the feeder and crusher adjacent the mouth of the crusher for providing an immediately responsive control of the feed rate being delivered to the crusher.

3 Claims, 3 Drawing Sheets

CRUSHER CONTROL SYSTEM

FIELD OF THE INVENTION

This invention relates to the production of aggregates, and particularly to a system for controlling the throughput of size reduction equipment, such as crushers in a rock crushing plant.

BACKGROUND OF THE INVENTION

Rock crushing plants are used for the production of aggregates. Within a rock crushing plant there are usually three stages of crushing: primary crushing, secondary crushing, and tertiary crushing. Quarry rock is fed to a primary crusher in order to reduce the size of the rock to below a given maximum size. Typically a Jaw crusher or Gyratory crusher is used in the primary crushing stage. The size of the quarry rock is reduced to 8 inches in diameter or less (minus 8 inches) by the primary crusher, and is then conveyed to a stockpile.

The stockpile generated by the primary crusher is transferred onto a conveyor by a feeder, delivered to screens for classifying the rock, and then to a secondary crusher. In ordinary plant operations, only one secondary crusher is required. The secondary rock crusher is capable of reducing the size of the rock to less than a given size normally minus 4 inches. It is not possible to control the minimum particle size that will be produced. The desired maximum diameter of the rock being crushed depends upon the intended use of the rock, whether it be for concrete aggregate, roadstone, or a finer product, such as sand. Some of the rock leaving the primary and secondary stages will be reduced in size enough so that no further crushing is required. The remainder of the rock will need to be crushed in the secondary and tertiary crushers respectively. Accordingly, the output of the primary, secondary and tertiary crushing stages go through classifying screens so that only the larger diameter rock is crushed in the secondary and tertiary crushers respectively. The smaller diameter rock that is the size of the desired product is temporarily stored and later transported out of the plant as a final product.

The output of the secondary crusher is classified to remove the dust and smaller diameter rock with screens. The larger diameter rock is conveyed to a surge pile and then fed to a tertiary crusher. Cone crushers are usually used in the tertiary stage, and for very fine tertiary crushing, Gyradisc crushers are used. The maximum size of the tertiary crusher output can be chosen by setting a desired gap dimension between the crushing surfaces of the crusher. As with the secondary crushers, the product of the tertiary crushers needs to be classified to obtain the desired final product.

In a rock crushing plant, each of the primary, secondary and tertiary stages is operated independently of the other. That is, the feed to the secondary crusher is obtained from a stockpile. Likewise, the feed to the tertiary crusher is obtained from a bin or surge pile. As a result, the focus of optimizing overall plant throughput is divided into optimizing the throughput for each of the crushing stages with priority being given to the least productive stage.

The difficulty in optimizing the efficiency of the crushers in a rock crushing plant relates to the extremely hazardous environment in which the process control equipment must operate and the constantly changing variables that must be accounted for. Sensing equipment that is intended to contact the rock, such as a level sensor or the like, must withstand occasional, severe impacts and also withstand the penetration and build-up of fine particulate matter, such as rock dust. Further, the system must be able to accommodate changes in operating parameters that are frequently changed by the operators in accordance with their needs.

The variables that are subject to change during a run include differences in hardness, size, and moisture content. For example, the feed at the beginning of a run will have a smaller average diameter than at the end of the run due to segregation of the rock in the surge pile from which the rock is fed. Also, the rock at the bottom of a pile will have a different moisture content than the rock that has been laying on the surface of the pile. Therefore, effective throughput control systems for rock crushers have been slow in development.

Modern size reduction equipment has been designed to operate more efficiently in accordance with the recognized need to increase throughput. Replacing equipment in a rock crushing plant, however, is ordinarily one of the least viable alternatives to the owner, because the equipment, such as the crushers, is so expensive. As a result, a great need has developed for process control systems that can optimize the crusher efficiency and thereby increase the crusher throughput of existing crushers. Some of the variables that affect the operation of a crusher during a given run can be assumed to be fixed to a certain extent. For example, the hardness of the rock in a given run will remain substantially the same. Other variables cannot be fixed with such certainty, however, because they change as the length of the run continues. For example, the size of the rock and its moisture content changes as the surge pile is reduced. As another example, the setting of the gap between the crushing surfaces of the crusher will widen as the surfaces wear, and the rate of wear will depend upon the hardness of the rock being crushed. Therefore, for a control system to operate a crusher efficiently, it must take into account all of the variables, and deal with them whether they are fixed or subject to change.

The most controllable and result effective variable is the feed rate of rock delivered to the crusher. For cone crushers, the feed rate should be increased until the crushing cavity is filled, but not increased so much that the rock overflows the crusher. This results in the most efficient operation of a cone crusher. When the feed rate is such that the crushing cavity is always full, then the crusher is being choke fed. To ensure that the choke fed condition is maintained, the crusher bowl can be kept full and the feed rate controlled so that no overflow condition occurs. As the crushing cavity fills, the horsepower requirement for the prime mover of the crusher increases. When the crushing cavity is completely full and the crusher is operating under a choke fed condition, the motor driving the crusher operates within a peak range, and the feed rate can thereafter be controlled by monitoring the horsepower of the motor and adjusting the feed rate accordingly. As the crushing surfaces of the crushing cavity wear, however, the horsepower decreases and a control system operated by sensing horsepower alone would increase the feed rate and eventually overflow the crusher bowl, without timely intervention by an operator. To alleviate the overflow problem, and to signal an operator to reset the crushing cavity gap, a level control device, such as a level probe, can be used to signal the control system that adding feed will cause an overflow condition. If the gap is not then reset, the crusher can continue to operate by simply increasing the feed rate when the level control device indicates that the crusher bowl is below a predetermined level, and decreasing the feed rate when the level control device indicates that the crusher bowl is filled above that level.

Control systems of the type mentioned are known. A programmable logic controller has been used to vary the feed rate to the crusher in accordance with signals received from a horsepower sensor and a level sensor so that an optimum feed rate for the present conditions is delivered to the crusher. Accordingly, the control system automatically accounts for changes in moisture content, rock size, and the wearing of crushing surfaces. This type of control system, in theory, therefore is adequate to increase crusher throughput by ensuring that the crusher cavity is always filled and therefore that the crusher is operated in a choke fed condition.

In practice, however, this type of control system is barely workable for many crushers presently operating in rock production plants. The secondary and tertiary crushers of these plants are fed from a stockpile or surge pile located a significant distance away from the mouth of the crusher. The rock must travel a long way from a feeder at a surge pile along a series of conveyor belts to the mouth of the crusher. As a result, when a control system commands the feeder to increase or decrease the feed rate in accordance with a sensed condition of the prime mover, or level sensor, the response time is too long and the unwanted condition occurs anyway. Locating the feeder closer to the crusher in order to alleviate this problem is impractical, if not impossible, because of the fixed constraints of the overall plant design. Also, the conveyors for transporting the rock cannot be eliminated or shortened, because the maximum slope of the conveyors cannot be increased. As a result, many of the secondary and tertiary cushers operating in rock production plants are being operated at less than 50 percent of their maximum efficiency, which represents the fact that most crushers in present use are not being choke fed.

SUMMARY OF THE INVENTION

It is an object of the invention to provide a control system for rock crushers in a rock crushing plant that can be retrofit to existing crushers for optimizing the efficiency of the crusher and increasing its throughput without having to make capital intensive replacements of existing equipment.

It is an object of the invention to provide a control system that can maintain a choke feed condition for a crusher by varying the feed rate to the crusher mouth even though the feeder and surge pile or bin are remotely located with respect to the crusher.

It is a further object of the invention to provide a crusher control system that responds to a level control probe within a crusher bowl and a horsepower sensor that senses the horsepower of the prime mover during crushing, and that controls the feed rate to the crusher mouth with a bypass component positioned adjacent or near to the crusher entrance for diverting a portion of or all of the flow of the rock intended to be fed into the crusher, and with a variable rate, feeder.

It is an object of the invention to provide a bypass component that can be adjusted to divert a portion of the flow of the rock destined for the crusher mouth to an existing return conveyor that is ordinarily provided for classifying the crusher output. The amount of rock diverted from the flow of rock destined for the crusher by the bypass component can be controlled by a programmable logic controller that also controls the feeder. Therefore the response time can be quickened when it is determined that the rate of feed being delivered to the crusher must be changed.

It is an object of the invention to provide a bypass component that can divert a portion of the rock destined for the crusher that can continuously function without the need for frequent maintenance in the harsh environment of a rock crushing plant. Further, it is an object to add the bypass component to the existing size reducing equipment of the rock crushing plant without the need to replace existing equipment.

DETAILED DESCRIPTION OF THE PREFERRED EMBODIMENT

Figure 1:
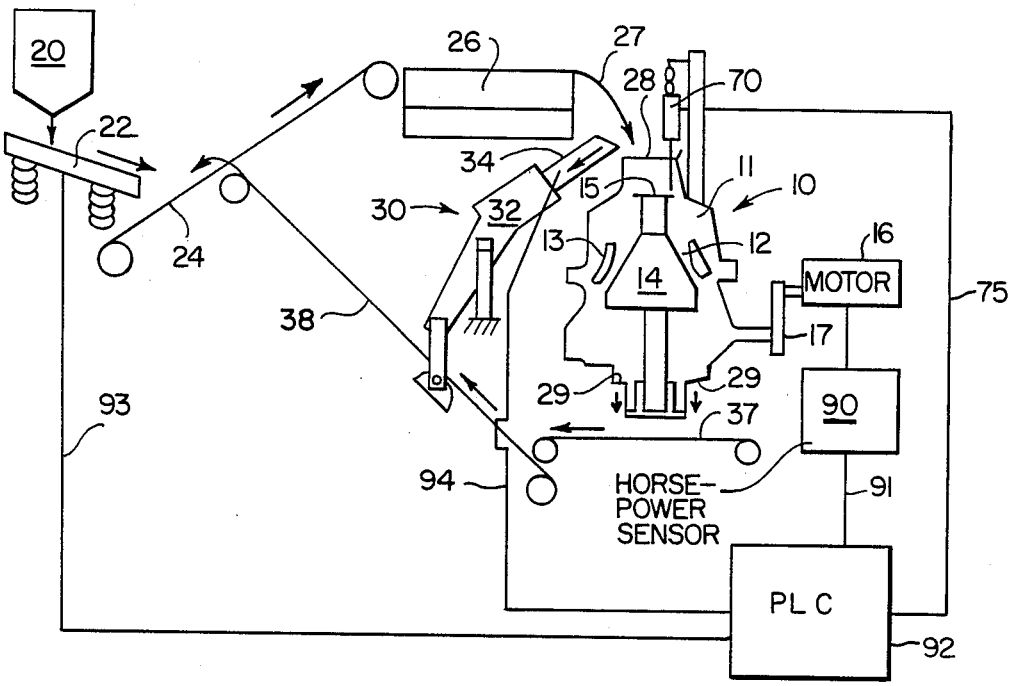
FIG. 1 is a diagram of the control system of the invention applied to a cone crusher.

The crusher control system of the invention is illustrated as it would be applied to a cone crusher in a secondary or tertiary crushing stage of a rock crushing plant. The crusher controls are applicable to Gyradisc crushers and other types of crushers that can be choke fed. For purposes of explanation, it is assumed that cone crusher 10 is operating in a tertiary crushing phase.

Cone crusher 10 is shown schematically to include a crusher bowl 11, and a crushing cavity 12 located between an outer crushing surface or mantle 13 and a rotating inner crushing surface or cone head 14. This design allows the crushed material to spread out as it works its way downwardly through the crusher.

Rock is fed from the output of a secondary crushing stage of the plant to a hopper 20 where it is temporarily stored. The rock in hopper 20 is delivered to a conveyor 24 by a vibratory feeder 22. The rock is conveyed along conveyor 24 to screens 26. The larger diameter rock that does not fall through the screens is fed into the crusher as indicated by arrow 27.

Figure 2:
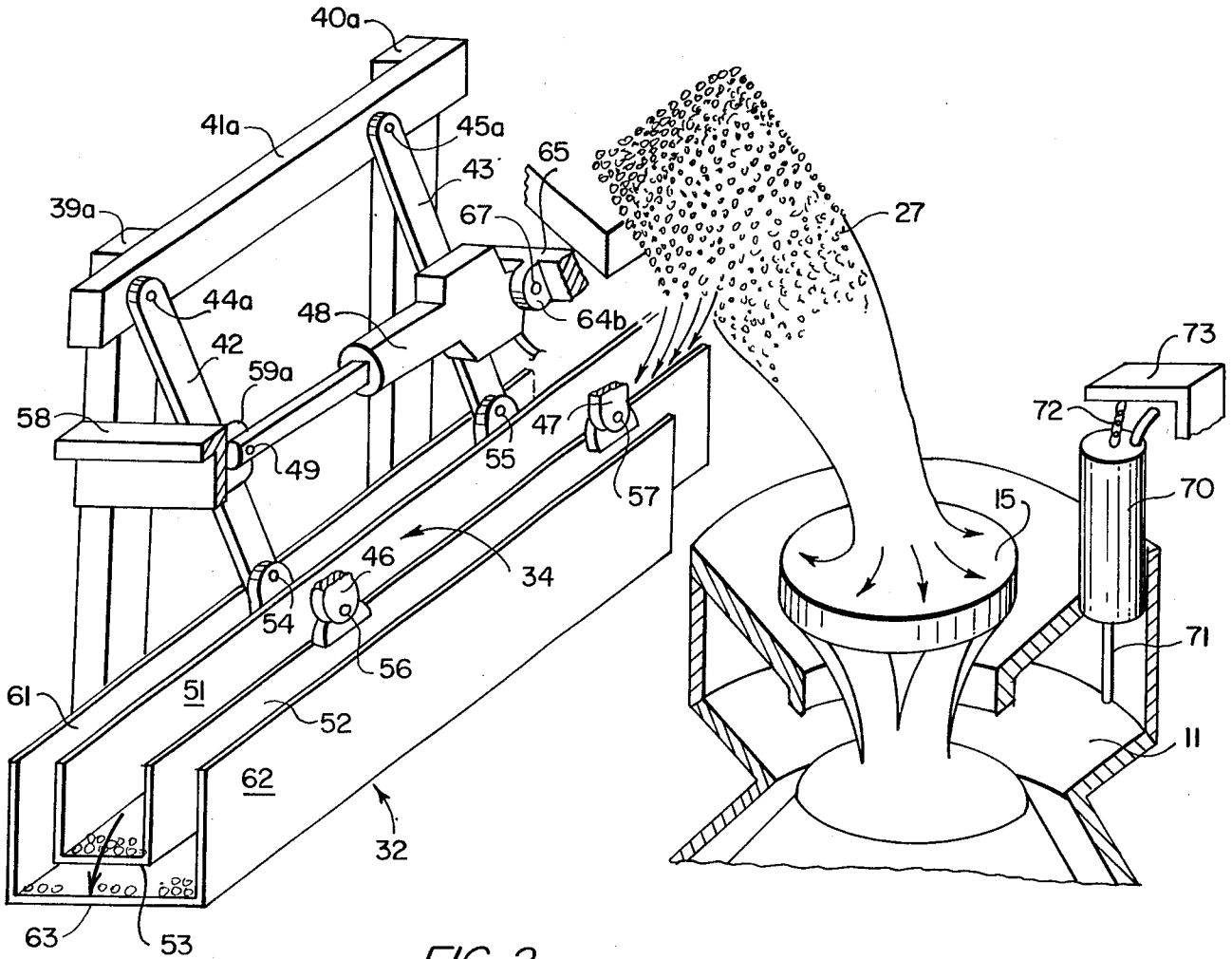
FIG. 2 is a detailed perspective view of the upper portion of the bypass component of the invention diverting a portion of the flow of rock away from the mouth of the cone crusher of FIG. 1.

A bypass component 30 is located between screens 26 and the mouth 28 of crusher 10. An extendible chute 34 of the bypass component is extendible into the flow of rock 27 being delivered from screens 26 to mouth 28 of the crusher, as shown in FIG. 2. The rock that is diverted from flow 27 slides downwardly by gravity in chute 34 into a larger stationary chute 32 and then onto a conveyor 38 that transports the diverted rock upwardly back onto conveyor 24 for return of the rock to screens 26.

The rock that is fed to the mouth of crusher 28 strikes a distributor plate 15 in the crusher. The rock is distributed evenly around crusher bowl 11 and falls into crushing cavity 12. If the feed rate is sufficient, the crushing cavity and bowl can be kept full. The crushed material of crusher 10 is discharged at 29 onto a conveyor 37, which is an existing conveyor in an ordinary plant. Conveyor 37 conveys the crushed rock to return conveyor 38 for return on conveyor 24 to the screens 26. The crushed rock must be returned to the screens, because it is an unclassified product when it is discharged from the crusher. Therefore, component 30 can be added to cooperate with the existing flow of rock within the plant without having to re-design or add to the existing conveyors.

Figure 3:
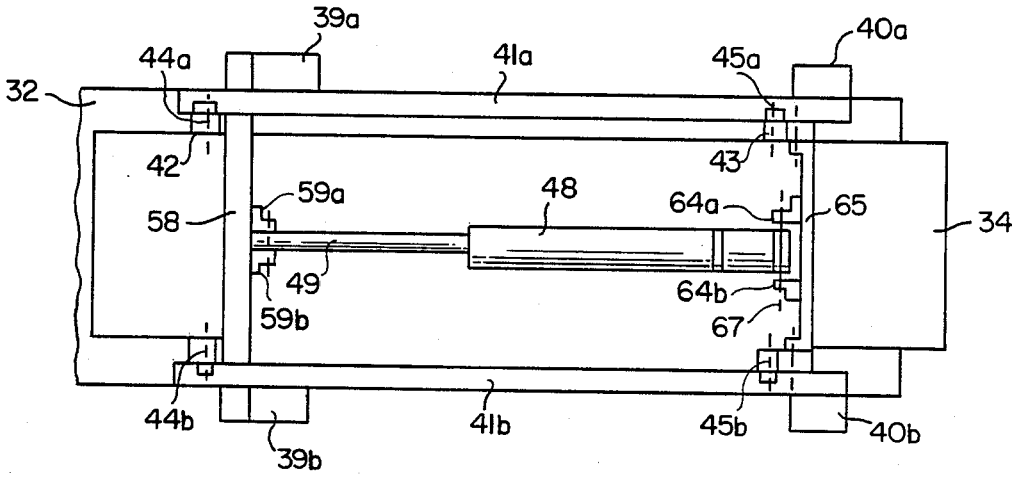
FIG. 3 is a top view of the bypass component of FIG. 2.
Figure 5:
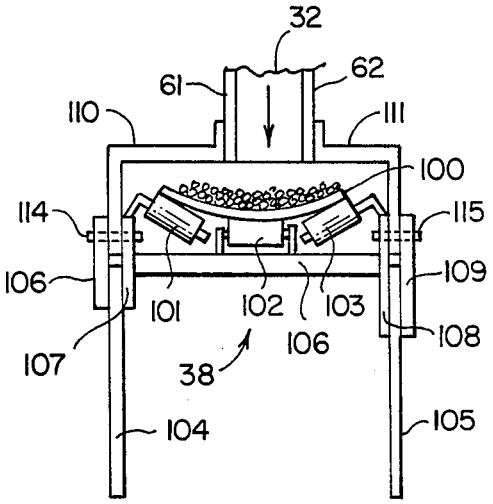
FIG. 5 is a partial end view of the bypass component of FIG. 2 shown pivotally mounted to a conveyor support structure.

The bypass component 30 is shown in FIGS. 2, 3 and 5. In FIG. 2, a detailed perspective view of the upper portion of the bypass component 30 is shown. The support structure for extendible chute 34 includes two vertical columns 39*a*, 39*b* and 40*a*, 40*b*. Stringer 41*a*, 41*b* are connected between columns 39*a*, 40*a* and 39*b*, 40*b* respectively, Arms 42, 43 and 46, 47 are pivotally connected to stringers 41*a*, 41*b* at 44*a*, 45*a* and 44*b*, 45*b* respectively. Arms 46 and 47 are partially shown in FIG. 2 for clarity. Arms 42, 43 and 46, 47 are pivotally mounted to the extendible chute side walls 51 and 52 respectively by pins, bolts, or the like 54–57. Therefore, extendible chute 34 is hung between the columns and stringers by arms 42, 43 and 46, 47 so that it swings within stationary chute 32.

Extending across from column 39*a* to column 39*b* on the other side of chute 32 is a cross support 58 that is welded to each of the columns. The cross support has a pair of flanges 59*a*, 59*b* for pivotally connecting one end of an actuator 48 by a pin or bolt 49. The opposite end 50 of the actuator is also pivotally mounted between like flanges 64*a*, 64*b* by a pin or bolt 67. Flanges 64*a*, 64*b* are fixed to a cross support 65 that extends between arms 43 and 47.

Actuator 48 may be electrically, pneumatically, or hydraulically driven. As the actuator extends, one end of the actuator pushes on cross support 65 and the other end pushes on cross support 58. Cross support 58 is fixed between the columns and is immovable, so chute 34 swings outwardly. When the actuator is retracted, the arms swing inwardly until they hang in a vertical position. The weight of chute 34 aids the actuator during retraction of the chute, but the movement of the chute is always under control of the actuator in both the extending and retracting directions.

The chute is driven into the flow of rock 27 upwardly at a steep angle, for example at about 45 degrees. The leading edge of extendible chute 34 is driven into the rock and the steepness of the chute causes the rock to be diverted into the extendible chute and slide further downwardly into the stationary chute 32 and onto conveyor 38. Therefore, this construction relies upon the geometry of the plant design to allow for a steep pick-off angle of the rock by extendible chute 34. On the other hand, if the plant design prevented a chute from being constructed at such a steep angle, the rock might get jammed in the chute. In this situation, chute 34 could be replaced with a self-propelled conveyor belt that would be supported by arms 42, 43 and 46, 47 in the same manner as chute 34 is supported. Alternatively, chute 34 could be replaced by a vibratory feeder if the plant design prevented the steep pick-off angle that is necessary to enable chutes 32 and 34 to work as gravity conveyors. Likewise, chute 32 could be replaced with a conveyor belt or vibratory feeder if necessary.

The extendible chute 34 must be capable of being continuously driven into and pulled out of rock flow 27 without jamming. Accordingly, the width of extendible chute 34 is much less than the width of stationary chute 32, and similarly the depth of extendible chute 34 is much less than the depth of stationary chute 32. This results in a clearance between the side walls 51, 52 of extendible chute 34 and side walls 61, 62 of chute 32. Similarly, a clearance between bottom wall 53 of chute 34 and bottom wall 63 of chute 32 is maintained. The dimension of these clearances exceeds the diameter of the largest rock occurring in rock flow 27. Accordingly, any rock diverted from flow 27 that works its way in between extendible chute 34 and stationary chute 32 will not cause the extendible chute to jam within the stationary chute. Appropriate adjustment is made to allow extendible chute 34 to swing outwardly into the flow of rock 27 and back without compromising the minimum clearance that must be maintained between the two chutes to prevent jamming.

As shown in FIG. 5, one embodiment of a pivoting support for mounting stationary chute 32 to the framework of conveyor 38 is shown. Conveyor 38 has a belt 100 that is supported by idler rollers 101–103. The idler rollers ar supported on a frame structure that includes vertical side frame members 104 and 105 and a horizontally extending cross beam 106. Fixed to frame members 104 and 105 are side plates 106, 107 and 108, 109 respectively. These side plates may be welded or bolted to the frame members. Foot portions 110 and 111, that are connected to the side walls 61 and 62 of chute 32 are received within the space between the respective side plates 106, 107 and 108, 109. The feet 110, 111 are pivotally supported between each respective set of side plates by pins 114, 115. This allows the chute to be pivoted away from the crusher when access to the crusher is desired. Additional structure shown schematically in FIG. 1 is provided to limit the extent of pivoting movement of the bypass component in the direction toward the crusher.

In order to optimize the efficiency of the cone crusher 10, it is necessary to ensure that the crushing cavity is choke fed, or completely filled. To accomplish this result, the crushing bowl 11 is kept full, but not so full that there is a danger of overflowing the crushing bowl and spilling rock onto the ground. In order to prevent the rock from overflowing, a level sensor 70 is provided that includes an actuator 71, which extends down into the crusher bowl 11 at any desired height.

Figure 4:
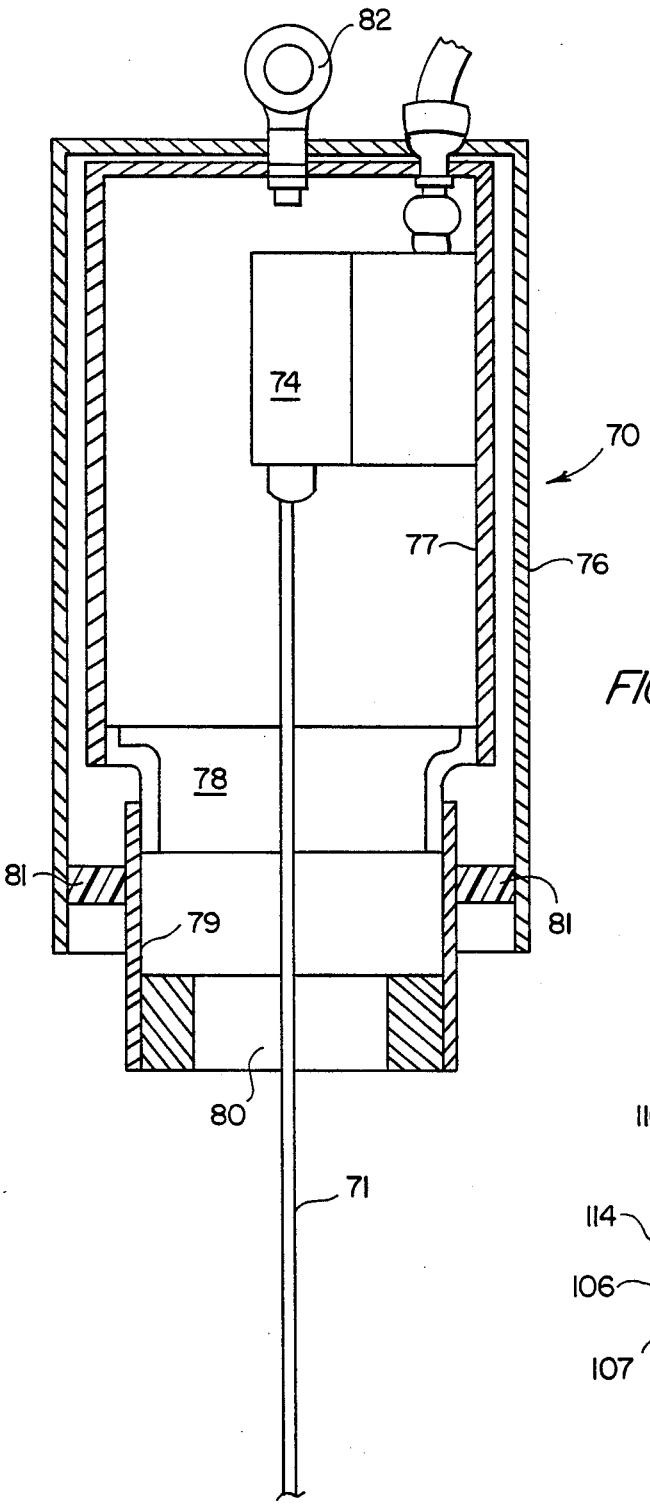
FIG. 4 is a section view of a probe designed for use with the control system of FIG. 1.

Level sensor 70 is mounted for free swinging movement on a chain 72 from a structural support 73, which can be of any conventional design. As shown in FIG. 4, actuator 71 is connected to microswitch 74. The switch is tripped when the level of rock within the bowl reaches the tip of the actuator, and causes it to move. When the trip is switched, a control signal is sent out over line 75 that the switch has been tripped. As the level sensor is subject to being impacted by the rock entering crusher 10, it is housed within a cylindrical steel housing 76. Within the housing 76 is a mounting frame 77 to which the microswitch 74 is attached. Frame 77 is fixed to a chase nipple 78, which is in turn fixed to a lower extension 79 having an opening 80 through which actuator 71 protrudes. Opening 80 must be small enough to prevent stray rock from bouncing up inside the housing, and must be large enough to allow for movement of the actuator in order to trip the microswitch. A suitable seal between the extension 79 and housing 76 is provided at 81 to prevent the accumulation of dust between the frame and housing. Chain 72 can be attached to an eyehook 82. The free swinging movement of the probe reduces the shock that occurs should a stray rock impact the level sensing probe.

The cone crusher 10 is driven by a prime mover or motor 16 through a transmission 17 shown schematically. A horsepower sensor 90 provides a digital output signal proportional to a range of the operating horsepower of motor 16. Any conventional horsepower sensing device can be used. For an electric prime mover, the current supplied to motor 16 can be used to sense the horsepower of the motor. First, the current is transformed to a lower AC voltage and rectified to provide a DC signal. The DC signal thus produced is proportional to the horsepower of the motor 16. As the level of the DC signal changes, the horsepower sensor provides a stepped output or digital signal indicative of the range of horsepower in which the motor is operating.

The digital output signal of the horsepower sensor is transmitted along line 91 and input to a programmable logic controller 92. Also, the digital signal from line 75 of the level sensor is provided as an input to the programmable logic controller. The programmable logic controller is capable of sending command signals over lines 93 and 91 to the vibrator feeder 22 and bypass component 30 respectively in accordance with the sensed level and horsepower conditions. The programmable logic controller functions as follows. When the horsepower sensor indicates that the motor 16 is no driving the crusher at near peak horsepower, the flow rate to the crusher is increased by sending a signal along line 93 to the vibratory feeder 22 to increase the amplitude of oscillation of the feeder and thereby increase the amount of rock being delivered onto conveyor 24. When the horsepower sensor detects that motor 16 is driving the crusher within a maximum range of the motor's horsepower rating, then the rate of feed added to conveyor 24 by feeder 22 is stabilized. Accordingly, so long as the horsepower of the motor 16 is maintained within a peak range of the rated performance, then the feeder will continue to feed the same amount of rock to the crusher.

In order to adapt the control system of the invention to existing equipment, a motor driven potentiometer may be used in conjunction with the existing vibratory feeder controls to increase and decrease the rate of oscillation of the feeder. The signal from PLC 92 to vibratory feeder 22 along line 93 need only be of the correct time duration and polarity to drive the motorized potentiometer to increase the vibratory feed control knob or lever, or decrease it.

In some instances, the PLC is unable to efficiently control the feed rate to the crusher by only changing the vibration of feeder 22, because the rock must travel all the way from the feeder 22 to the mouth 28 of the crusher before any difference in feed rate is realized by the crusher 10 and motor 16. This situation may result at start-up or after a change has been made to the setting of the cone crusher, or when a new feed of rock is being fed to the crusher. In order to establish an optimum throughput quickly, the bypass component of the control system is utilized.

Bypass component 30 is commanded to extend and retract in order to change the feed rate entering the crusher through mouth 28. The PLC 92 commands the bypass component to divert a larger or smaller portion of the rock flow away from the mouth of the crusher by moving extendible chute 34 into and out of the flow of rock 27. The linear actuator expands or contracts in accordance with the polarity of the signal received. The signal is applied for a predetermined time duration that is correlated to the desired amount of expansion or contraction. The extendible chute 34 moves accordingly a predetermined distance. As a result of chute 34 being driven perpendicularly into the flow of rock 27 from one side, the further the chute is extended into the flow of rock, the greater the amount of rock is diverted from the mouth 28 of crusher 10. Accordingly, the duration and polarity of the signal applied to the linear actuator from the PLC is proportional to the amount of rock that will be diverted from the flow 27 of rock and returned to the screens 26 by conveyors 38 and 24.

It is particularly advantageous, although not mandatory that conveyor 38 deliver the rock diverted through component 30 onto conveyor 24 about midway of conveyor 24. By this arrangement, the excess diverted rock is added to conveyor 24 at a point where the feed rate has already been reduced in accordance with a signal sent to the vibratory feeder 22 by the PLC. In this way, as a steady state feed rate is established, the extendible bypass chute 34 is retracted as the oscillation of the vibratory feeder is decreased a compensating amount.

The level sensor 70 completes the control system by intervening when the steady state flow rate condition is changed and an overflow condition is threatened. This steady state condition can be changed in a number of ways. For example, an operator of the plant may change the setting of the gap between the crushing surfaces of the cone crusher in order to achieve a coarser or finer product. Also, if a continuous run of rock is being crushed, then the crushing surfaces may begin to wear resulting in a widening of the gap. For hard granite based rock, this wear condition can occur within a day's time. When the latter type of change occurs, the horsepower sensor senses a drop in horsepower as the gap is widened and the PLC responds by increasing the feed rate of feeder 22. In other words, the system believes that the crushing cavity is no longer being filled at the present feed rate, so the feed rate should be increased. If the feed rate increases significantly, the crusher will not be able to keep up and so a spillover condition would occur. Level sensor 70 is provided to prevent this type of occurrence. If the gap is not reset, then the system will continue to operate under the primary control of the level sensor, by signaling the feeder to increase the feed when the rock in the crusher bowl is below the actuator 71 of level sensor 70 and to slow feeder 22 when the level sensor 70 has been tripped. Therefore, control of the system is maintained even though a variable in the system has been significantly changed.

To install the process control system, it is not necessary to re-design the plant. The bypass component can be a self-standing structure having a discharge that feeds directly onto a return conveyor 38, which is ordinarily provided adjacent an output conveyor 37 for conveying the crusher output to the screens. The probe 70 can be mounted on a frame 73 fixed to the outer housing of crusher 10. The horsepower sensor 80 is of a conventional nature and needs only be connected to the current supply for motor 16. The PLC is a small component that can be added to the plant operator's control room. As explained above, the vibratory feeder is typically provided with a control knob for adjusting the feed rate. In the preferred embodiment, a motorized potentiometer is attached to the control knob so that automatic adjustment of the control knob can be performed by providing the correct polarity signal along line 93 from the PLC 92 for power adjustment of the control knob of the vibratory feeder. Similarly, the control of linear actuator 48 can be achieved by supplying the appropriate signal from PLC along line 94. Therefore, the entire control system can be added to an existing plant, of conventional design, without requiring the replacement of expensive crushing equipment or changing the design layout of the conveyors.

It can be appreciated that the foregoing invention can be practiced by modifying the bypass chute structure in any number of ways so that a portion of the rock is diverted away from the flow of rock entering the mouth of the crusher in incremental amounts. The significance of the preferred embodiment illustrated in FIG. 2 is that it will operate continuously without jamming, because the clearance between the inner and outer chute is maintained in excess of the largest diameter rock found in the flow of rock 27. Accordingly, it is understood that within the scope of the appended claims the invention may be practiced as described.

I claim:

1. A control system for a rock crusher operating in a rock crushing plant, comprising:

the plant having a feeder, and first conveyor means for conveying rock from the feeder to a mouth of a crusher;

the crusher having a motor for driving the crusher;

a horsepower sensor for sensing the horsepower output of the motor driving the crusher;

a programmable logic controller having means for controlling the output of the feeder;

a level sensor mounted in the crusher for sensing the level of rock within a crusher bowl of the crusher;

second conveyor means for receiving rock discharged from the crusher and for returning the discharged rock to the first conveyor means; a bypass chute means component located between said first conveyor means and the mouth of the crusher for diverting a selectable portion of the flow of rock intended to be delivered to the mouth of the crusher from said first conveyor means and for delivering said diverted rock onto said second conveyor means;

said programmable logic controller further having means for controlling the amount of rock diverted from the flow of rock intended to be delivered leaving said first conveyor means and intending to be delivered into the mouth of the crusher; and said programmable logic controller having means for receiving the sensed horsepower signal and level signal from the horsepower sensor and the level control device respectively, and commanding the feeder and bypass chute component respectively to correspondingly increase or decrease the feed rate of rock entering the mouth of the crusher.

2. The crusher control system according to claim 1, further comprising:

said bypass chute component having an extendible chute and a stationary chute, wherein said extendible chute is positioned within said stationary chute, and said chutes are positioned such that their longitudinal direction is perpendicular to the flow of rock being conveyed from said first conveyor means into the mouth of the crusher.

3. The crusher control system as claimed in claim 2, wherein said bypass chute component further includes a column means and arms pivotally mounted on said column means at one end of each of said arms and pivotally mounted at the other end of each of said arms to said extendible chute for supporting said extendible chute within said stationary chute; and linear actuator means having opposite ends, one of said ends being pivotally mounted to one of said arms, and the other of said ends being mounted to push against one of said column structures for moving said arms and said extendible chute outwardly into the flow of rock relative to said stationary chute.

* * * * *